US011087700B1

(12) United States Patent
Kumar et al.

(10) Patent No.: US 11,087,700 B1
(45) Date of Patent: Aug. 10, 2021

(54) SYSTEM AND METHOD FOR IMAGE ENHANCEMENT ON A DIGITAL DISPLAY DEVICE

(71) Applicant: Palacio Inc., Santa Clara, CA (US)

(72) Inventors: Shailesh Kumar, Noida (IN); Rahul Ranjan, Fremont, CA (US); Andrew Kurtz, Oakland, CA (US)

(73) Assignee: Palacio Inc., Santa Clara, CA (US)

( * ) Notice: Subject to any disclaimer, the term of this patent is extended or adjusted under 35 U.S.C. 154(b) by 0 days.

(21) Appl. No.: 16/876,589

(22) Filed: May 18, 2020

(51) Int. Cl.

| | |
|---|---|
| ***G09G 3/34*** | (2006.01) |
| ***G09G 5/04*** | (2006.01) |
| ***G09G 5/00*** | (2006.01) |
| ***G09G 5/10*** | (2006.01) |

(52) U.S. Cl.
CPC ..... *G09G 3/3413* (2013.01); *G09G 5/005* (2013.01); *G09G 5/04* (2013.01); *G09G 5/10* (2013.01); *G09G 2320/06* (2013.01); *G09G 2320/0626* (2013.01); *G09G 2320/0666* (2013.01); *G09G 2360/144* (2013.01)

(58) Field of Classification Search
CPC ..... G09G 3/3413; G09G 5/04; G09G 5/005; G09G 5/10; G09G 2320/06; G09G 2320/0626; G09G 2320/0666; G09G 2360/144
See application file for complete search history.

(56) References Cited

U.S. PATENT DOCUMENTS

| | | | | |
|---|---|---|---|---|
| 9,516,288 | B2 | 12/2016 | Holub | |
| 2009/0167736 | A1* | 7/2009 | Seydoux | G06F 3/14 345/207 |
| 2014/0285477 | A1* | 9/2014 | Cho | G09G 5/06 345/207 |
| 2014/0375704 | A1* | 12/2014 | Bi | G09G 3/3233 345/694 |
| 2015/0070400 | A1* | 3/2015 | Motta | G09G 3/3406 345/690 |
| 2016/0133227 | A1* | 5/2016 | Yoon | G09G 5/02 345/593 |
| 2018/0108329 | A1* | 4/2018 | Vukicevic | G09G 5/10 |

FOREIGN PATENT DOCUMENTS

| | | |
|---|---|---|
| EP | 1911013 A2 | 4/2008 |
| EP | 3486895 A1 | 5/2019 |

* cited by examiner

*Primary Examiner* — Brent D Castiaux
(74) *Attorney, Agent, or Firm* — Jason C. Cameron

(57) ABSTRACT

A system for image enhancement on digital display device is disclosed. The system includes an image processing subsystem including a digital art metadata collection module to measure the ambient condition on a digital art piece using sensors. The digital art metadata collection module collects a set of metadata corresponding to the digital art piece by analysing the ambient condition. The image processing subsystem includes an image adjustment module to modify parameters on digital display device based on the set of metadata using one or more image processing techniques. The image adjustment module generates a target digital image representative of a printed image quality based on the modified parameters.

20 Claims, 5 Drawing Sheets

SYSTEM AND METHOD FOR IMAGE ENHANCEMENT ON A DIGITAL DISPLAY DEVICE

BACKGROUND

Embodiments of the present disclosure relate digital art frames, and more particularly to, a system and method for image enhancement on a digital display device.

Physical surfaces (traditional painting) show a particular colour based on light reflection principle. When the ambient light falls on it, the molecules in the surface absorb certain wavelengths of incoming light and reflect other wavelengths. On the other hand, digital displays work on the principle of light emission (LED based pixels). They read an image to be rendered, identify the R, G, B components of each pixel in the image and emit a light for each pixel separately faithfully replicating the encoded R, G, B values. Thus, an image on a digital display appears the same no matter what the surrounding lighting conditions are. The digital display neither adapts to ambient brightness nor does it adapt to ambient colour Recent displays on devices like mobile phones and book readers have started to adapt based on ambient brightness level. Such adaptive functionality is achieved using brightness sensors built into the device. Brightness adaptivity is important in devices like book readers and mobile phones so that users can read and see what is being displayed on the device properly. However, such devices do not have stringent requirements of mimicking the behaviour of physical surfaces. Standard monitors in the market cannot display images in a realistic way (or look like a printed version) so viewing art or photograph on the standard monitors is stressful and not suitable, as one watch art or photograph from a short distance.

Hence, there is a need for an improved system and method for image enhancement of a digital display device to address the aforementioned issue(s).

BRIEF DESCRIPTION

In accordance with an embodiment of the present disclosure, a system for image enhancement on a digital display device is provided. The system includes an image processing subsystem hosted on a server. The image processing subsystem includes a digital art metadata collection module configured to measure ambient condition on a digital art piece of the digital display device using a plurality of sensors coupled to the digital display device. The digital art metadata collection module is also configured to collect a set of metadata corresponding to the digital art piece of the digital display device by analysing the ambient condition measured. The image processing subsystem further includes an image adjustment module operatively coupled to the digital art metadata collection module. The image adjustment module is configured to modify one or more parameters on the digital display device based on the set of metadata collected by using one or more image processing techniques. The image adjustment module is further configured to generate a target digital image representative of a printed image quality based on the one or more parameters modified under the ambient condition.

In accordance with another embodiment of the present disclosure, a method for image enhancement on a digital display device is provided. The method includes measuring, by a digital art metadata collection module, ambient condition on a digital art piece of the digital display device using a plurality of sensors coupled to the digital display device. The method further includes collecting, by the digital art metadata collection module, a set of metadata corresponding to the digital art piece of the digital display device by analysing measured ambient condition. The method further includes modifying, by the image adjustment module, one or more parameters on the digital display device based on the set of metadata collected by the digital art metadata collection module using one or more image processing techniques. The method further includes generating, by the image adjustment module, a target digital image representative of a printed image quality based on the one or more parameters under the ambient condition.

In accordance with yet another embodiment of the present disclosure, a digital display device is provided. The device includes a display screen incorporated in a frame, wherein the display screen is configured to display a digital art piece, wherein the digital art piece comprising a matrix of pixels. The device also includes a driving circuit electrically coupled to the display screen, wherein the driving circuit is configured to control the display screen to display the digital art piece. The device further includes a communication unit communicably coupled to a server. The server includes an image processing subsystem including a digital art metadata collection module configured to measure ambient condition on a digital art piece of the display screen using a plurality of sensors coupled to the display screen. The digital art metadata collection module is configured to collect a set of metadata corresponding to the digital art piece of the display screen by analysing measured ambient condition. The image processing subsystem further includes an image adjustment module operatively coupled to the digital art metadata collection module. The image adjustment module is also configured to modify one or more parameters on the display screen based on the set of metadata collected by the digital art metadata collection module using one or more image processing techniques. The image adjustment module is further configured to generate a target digital image representative of a printed image quality based on the one or more parameters under the ambient condition.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which.

Figure 1:
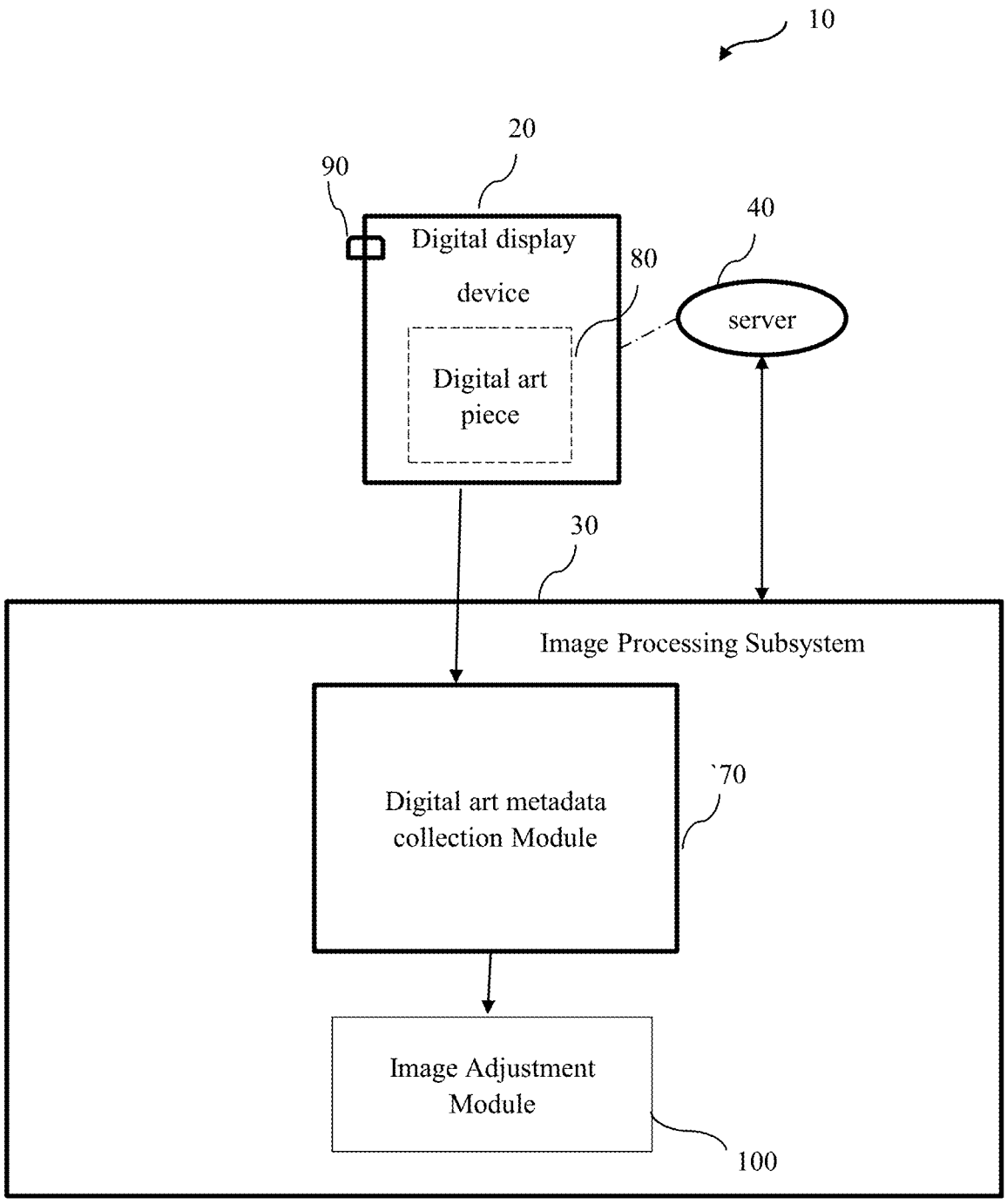
FIG. 1 is a block diagram representation of a system for image enhancement in a digital display device in accordance with an embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated system, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method (250) that comprises a list of steps does not include only those steps but may include other steps not expressly listed or inherent to such a process or method (250). Similarly, one or more devices or subsystems or elements or structures or components preceded by "comprises . . . a" does not, without more constraints, preclude the existence of other devices, sub-systems, elements, structures, components, additional devices, additional sub-systems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present disclosure relate to system and method for image enhancement on a digital display device. The system includes an image processing subsystem hosted on a server. The image processing subsystem includes a digital art metadata collection module configured to measure ambient condition on a digital art piece of the digital display device using a plurality of sensors coupled to the digital display device. The digital art metadata collection module is also configured to collect a set of metadata corresponding to the digital art piece of the digital display device by analysing the ambient condition measured. The image processing subsystem further includes an image adjustment module operatively coupled to the digital art metadata collection module. The image adjustment module is configured to modify one or more parameters on the digital display device based on the set of metadata collected by the digital art metadata collection module using one or more image processing techniques. The image adjustment module is further configured to generate a target digital image representative of a printed image quality based on the one or more parameters modified under the ambient condition.

FIG. 1 is a block diagram representation of a system 10 for image enhancement on a display device 20 in accordance with an embodiment of the present disclosure. The system 10 includes an image processing subsystem 30 hosted on a server 40. In one embodiment, the server 40 may be a cloud server. In another embodiment, the server 40 may be a local server of a computing device or the digital display device. In such an embodiment, the computing device may include a computer, a tablet, a laptop, a mobile phone or the like. The image processing subsystem 30 includes a digital art metadata collection module 70 which measures the ambient condition on a digital art piece 80 of the digital display device 20 using multiple sensors 90 coupled to the digital display device 20. As used herein, the digital art piece is a digital image of an artwork such as a painting on the digital display device. In one embodiment, the multiple sensors 90 may include at least one of a colour sensor, a brightness sensor, an infrared (IR) sensor or a combination thereof. The ambient condition may include a plurality of lighting conditions including colour temperature changes during day or evening or night (under different light bulbs present in the room such as yellow, white, blue, red or green or the like). The digital art metadata collection module 70 collects a set of metadata corresponding to the digital art piece 80 of the digital display device 20 by analysing the ambient condition measured. In one embodiment, the set of metadata may include at least one of brightness, sharpness, noise, colour, texture, saturation or a combination thereof. The brightness sensor and colour sensor along with the IR sensor continuously provide changing ambience data to the digital display device 20. Such set of metadata includes, but is not limited to, white point of the ambient illumination under which the digital display device 20 for the digital art piece 80 is acquired.

The image processing subsystem 30 further includes an image adjustment module 100 operatively coupled to the digital art metadata collection module 70. The image adjustment module 100 also modifies one or more parameters on the digital display device 20 based on the set of metadata collected by the digital art metadata collection module using one or more image processing techniques. In a specific embodiment, the one or more parameters may include at least one of brightness, sharpness, noise, colour, texture, saturation or a combination thereof. The one or more parameters under the specified brightness and colour sensor information may be set and the image processing filters adjusts the images in real time. The reflection behaviour is multiplicative in nature. In other words, the amount of light reflected by sample printed art piece 60 is proportional to ambient light while the reflection coefficient is wavelength dependent for a given surface. The same idea is used to achieve colour adaptation inside the digital display device 20 and a colour adaptation filter is a non-linear implementation of such multiplicative behaviour.

The colour sensor output includes four channels, where each channel is 16 bit. The four channels are red (R), green (G), blue (B) and clear (C). The four channels measure intensity of light falling on the colour sensor using different colour filters. The clear channel measures all visible light falling on the colour sensor. The red channel has a filter which corresponds to visible light spectrum corresponding to red component. Similarly, green and blue channels have corresponding filters. The channel output is quantized into 16 bits. However, the colour sensor is able to handle a much wider dynamic range. Such situation is achieved by the integration time and gain factor for the colour sensor. Roughly, the colour senor counts the number of light photons falling on the sensor for a period determined by the integration time of the colour sensor. Under low light conditions, the integration time has to be increased so that colour sensor has enough time to measure the light falling on the colour sensor. Under bright light conditions, the integration time should be reduced. Additionally, gain factor may be increased so that the output of the channel has values which are easily distinguishable. Essentially, the actual measurement of light falling on the sensor depends on the integration time, gain factor and 16-bit outputs of channels. The quantized infrared component (ir) is estimated using below mentioned equation (1):

$$\text{ir}=(\bar{r}+\bar{g}+\bar{b}-\bar{c})/2 \quad (1)$$

where a denote the gain factor, $\tau$ denote the integration time, $\bar{r}$ denote the 16-bit output of R channel, $\bar{g}$ is the 16-bit output of G channel, $\bar{b}$ is the 16-bit output of B channel, $\bar{c}$ is the 16-bit output of C channel of the colour sensor.

Furthermore, as a next step, the infrared component is removed from the colour channels which is achieved by below mentioned equations (2)-(5):

$$\hat{r}=\bar{r}-\text{ir} \quad (2)$$

$$\hat{g}=\bar{g}-\text{ir} \quad (3)$$

$$\hat{b}=\bar{b}-\text{ir} \quad (4)$$

$$\hat{c}=\bar{c}-\text{ir} \quad (5)$$

Where $\hat{r}$, $\hat{g}$, $\hat{b}$, $\hat{c}$ are IR compensated R, G, B and C channels. Special care has to be given for low light and heavy light conditions as human eyes tend to saturate in such conditions. Brightness adaptation is handled separately by adjusting the backlight brightness level of the digital display device 20 in accordance with the ambient luminance level. Such relationship is logarithmic in nature.

A quantity based on gain factor and integration time is counts per lux CPL which is calculated using the below mentioned equation (6):

$$\text{CPL}=\text{constant}*\tau/\alpha \quad (6)$$

Where constant is dependent on the characteristic of device. The counts per lux is proportional to the integration time and inversely proportional to the gain.

Finally, the lux is calculated by below mentioned equation (7):

$$L=\gamma_r\hat{r}+\gamma_g\hat{g}+\gamma_b\hat{b}/\text{CPL} \quad (7)$$

where L denotes the lux of light falling on the device. Lux is essentially a measure on ambient brightness. The quantities $\gamma_r$, $\gamma_g$, $\gamma_b$ are characteristic of individual sensor but they had to be adjusted a bit to get the lux calculation correct. The brightness lux value feeds into the backlight intensity of the display. The relative colour values feed into the adjustment of individual pixel R, G, B components of an image. The image adjustment module 100 receives uses the feedback from colour sensor, brightness sensor and metadata information of the sample printed art piece 60 and applies the one or more image processing techniques including noise adjustment, sharpness adjustment, colour temperature adjustment, brightness adjustment or the like along with brightness adjustment of the digital display device 20.

The backlight intensity is in percentage between 0 to 100 which is computed using following equation (8):

$$\text{bl}=\delta_a \log(L)+\delta_b$$

where the coefficients $\delta_a$ and $\delta_b$ have been estimated using extensive testing and regression on training images.

Moreover, the one or more image processing techniques are applied to manipulate the pixel intensity where individual pixel R, G, B components are adjusted as per reflection theory principle. The implementation of reflection theory principle is given below:

$$R_{i,j}=\eta_r R_{i,j}$$

$$G_{i,j}=\eta_g G_{i,j}$$

$$B_{i,j}=\eta_b B_{i,j}$$

where the multipliers $\eta_r$, $\eta_g$, $\eta_b$ depends on multiple parameters such as the average brightness of image (relative to ambient brightness), the white point of image (the conditions under which the image was captured originally) and the ambient light (relative) r, g, b.

Further, the image adjustment module 100 generates a target digital image 110 representative of a printed image quality of the sample printed art piece 60 based on the one or more parameters modified under the ambient condition. The estimation of the multipliers $\eta_r$, $\eta_g$, $\eta_b$ inside the image adjustment module results in overall colour adjustment of the image similar to real life physical images. In one embodiment, the image adjustment module 100 may generate the target digital image 110 representative of the printed image quality using sample data collected statistically in real time. The sample data is collected by comparing the print art behaviour statistically. The target digital image 110 on the digital display device 20 is adjusted using the image processing techniques and one or more filters to give a feeling of print like image quality under the plurality of lighting conditions.

In one embodiment, the image adjustment module 100 may determine a degree of modification of the one or more parameters based on historic data obtained by applying the first set of metadata on the digital art piece 80. In other words, the exact determination of the image parameters that may be adjusted and with what degree is also dependent on the prior understanding of similar operations on a similar image characterized by standard image parameters. The target digital image 110 mimics the sample printed art behaviour under the light conditions (different brightness levels, different ambience colour temperature or the like) so that a user gets the same experience as if they are looking at a print art. Human eyes perceive the print art colour or shape or brushstrokes due the light reflected by the print art. So, under different lighting conditions, light reflected by the sample printed art piece 60 is different from colour and brightness perspective and the combined reflection stimulates human eyes to create the perception of the art. The digital display device 20, by vary nature, is light emitting object. The target digital image 110 displayed on the digital display device 20 is experienced by the user because of appropriate amount of colour and brightness emitted by the digital display device 20.

The light emitting diode (LED) based digital display device 20 have a problem that if a particular pixel on the digital display device 20 is lit constantly at a particular brightness level for extended durations, the pixel may burn out and become dead. After that, the pixel constantly stays at the same brightness level. Such situation is problematic for display of digital art piece 80 on such digital display device 20 as an artwork is expected to be played for extended durations, thus no changes in pixel values leading to potential risk of screen burn in a short period of time. In a specific embodiment, the image adjustment module 100 may select a predetermined percentage of pixels periodically using a stochastic component of the one or more image processing techniques. In such an embodiment, the image adjustment module 100 may vary intensity of the predetermined percentage of the pixels to obviate pixel burn phenomenon.

Figure 2:
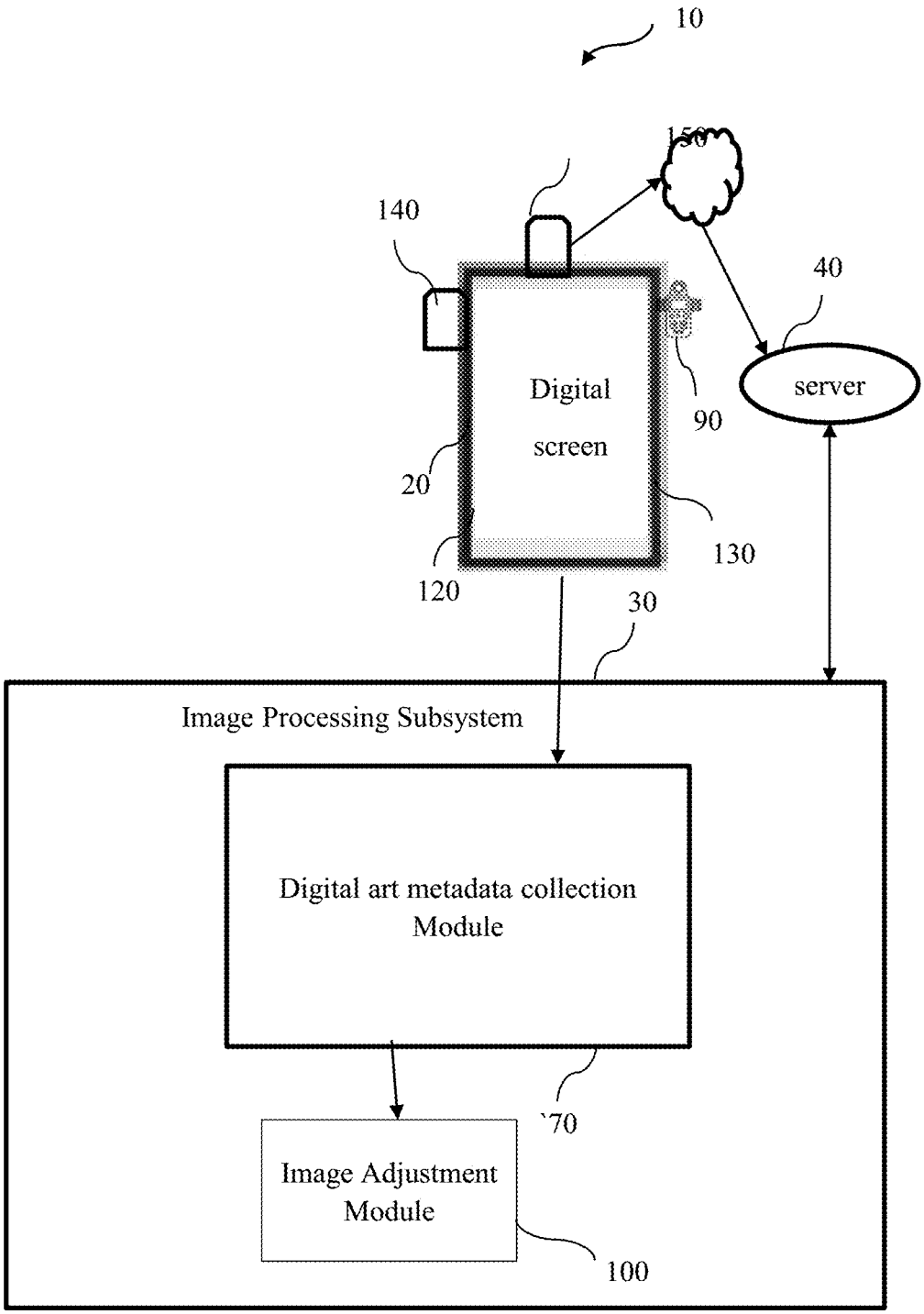
FIG. 2 is a block diagram representation of one embodiment of the system of FIG. 1, depicting the digital display device in accordance with an embodiment of the present disclosure.

FIG. 2 is a schematic representation of one embodiment of the system 10 for image enhancement on the digital display device 20 of FIG. 1 in accordance with an embodiment of the present disclosure. The FIG. 2 depicts the digital display device 20 which includes a display screen 120 incorporated in a frame 130. In one embodiment, the display screen 120 is inside the frame 130 such as a housing type structure. The housing, which may sometimes be referred to as a case. In such an embodiment, the frame 130 may be composed of a material including at least one of wood, glass, plastic, metal or a combination thereof. In an exemplary embodiment, the display screen 120 may include a light emitting diode (LED) based display screen, organic light-emitting diodes (OLEDs), plasma cells, liquid crystal display (LCD) display screen or other suitable image pixel structures. The display screen 120 displays a digital art piece 80 which includes a matrix of pixels.

Furthermore, the digital display device 20 includes a driving circuit 140 electrically coupled to the display screen 120. The driving circuit 140 controls the display screen 120 to display the digital art piece 80. As used herein, the driving circuit is a circuit used to control electrical or electronic circuits or components such as a high-power transistor, liquid crystal display and numerous others. The digital display device 20 further includes a communication unit 150 communicably coupled to a server 40. In one embodiment, the server 40 may be a cloud-based server. In another embodiment, the server 40 may include a local server on a computing device or the digital display device. The server 40 includes an image processing subsystem 30 including a digital art metadata collection module 70 and an image adjustment module 100 as described in the aforementioned FIG. 1.

Figure 3:
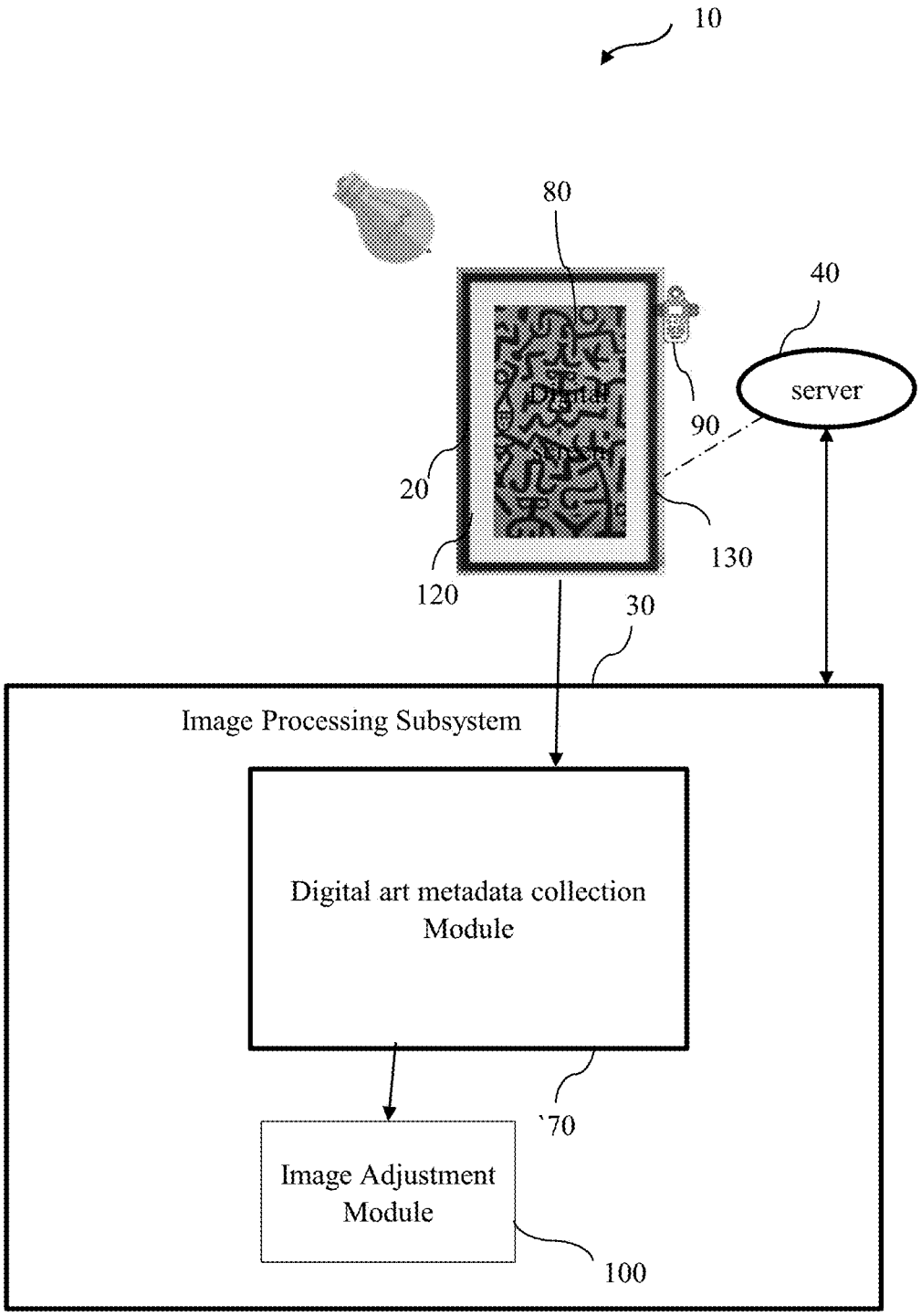
FIG. 3 is a schematic representation of an exemplary system for image enhancement in a digital display device of FIG. 1 in accordance with an embodiment of the present disclosure.

FIG. 3 is a schematic representation of an exemplary system 10 for image enhancement on the digital display device 20 of FIG. 1 in accordance with an embodiment of the present disclosure. Considering an example where the sample printed art piece is a painting placed in a room and a corresponding digital image as a digital art piece 80 is displayed on the display screen 120 of the digital display device 20. The digital metadata collection module 70 of the image processing subsystem 30 measures effect of the ambient condition on the digital display device 20 using multiple sensors 90. The multiple sensors 90 such as IR sensor, brightness sensor and colour sensor are coupled to a frame 130 of the digital display device 20 which captures the changes in the ambient conditions such as change in light, brightness or colours of screen of the digital display device 20.

Furthermore, the digital art metadata collection module 70 collects the set of metadata such as brightness, sharpness, colour, noise and white point of the ambient illumination under which the digital display device 20 for the digital art piece 80 is acquired. The set of metadata is collected from the digital image displayed on the display screen 120 upon analysis of the measured effect of ambient condition on the digital image. Furthermore, the image processing subsystem 30 includes an image adjustment module 100 which modifies one or more parameters on the digital display device 20 based on the set of metadata collected by the digital art metadata collection module using one or more image processing techniques.

For example, if the ambient light colour is yellow and the time is night time, then the image adjustment module 100 empowering the digital display device 20 accordingly reduces the brightness of the display screen 120 and adjusts or more specifically, boosts the yellow components in image pixels so that the digital image rendered on the display screen 120 looks very similar to the sample print art piece 60 under same yellow light. Similarly, if the ambient light is green and the day is bright day light more specifically afternoon time, then the image adjustment module 100 empowering the display screen 120 and accordingly increase the brightness of the display screen 120 and adjust the green components in image pixels so that the image rendered on the display screen 120 looks very similar to the sample printed art piece 60 under green light.

Figure 4:
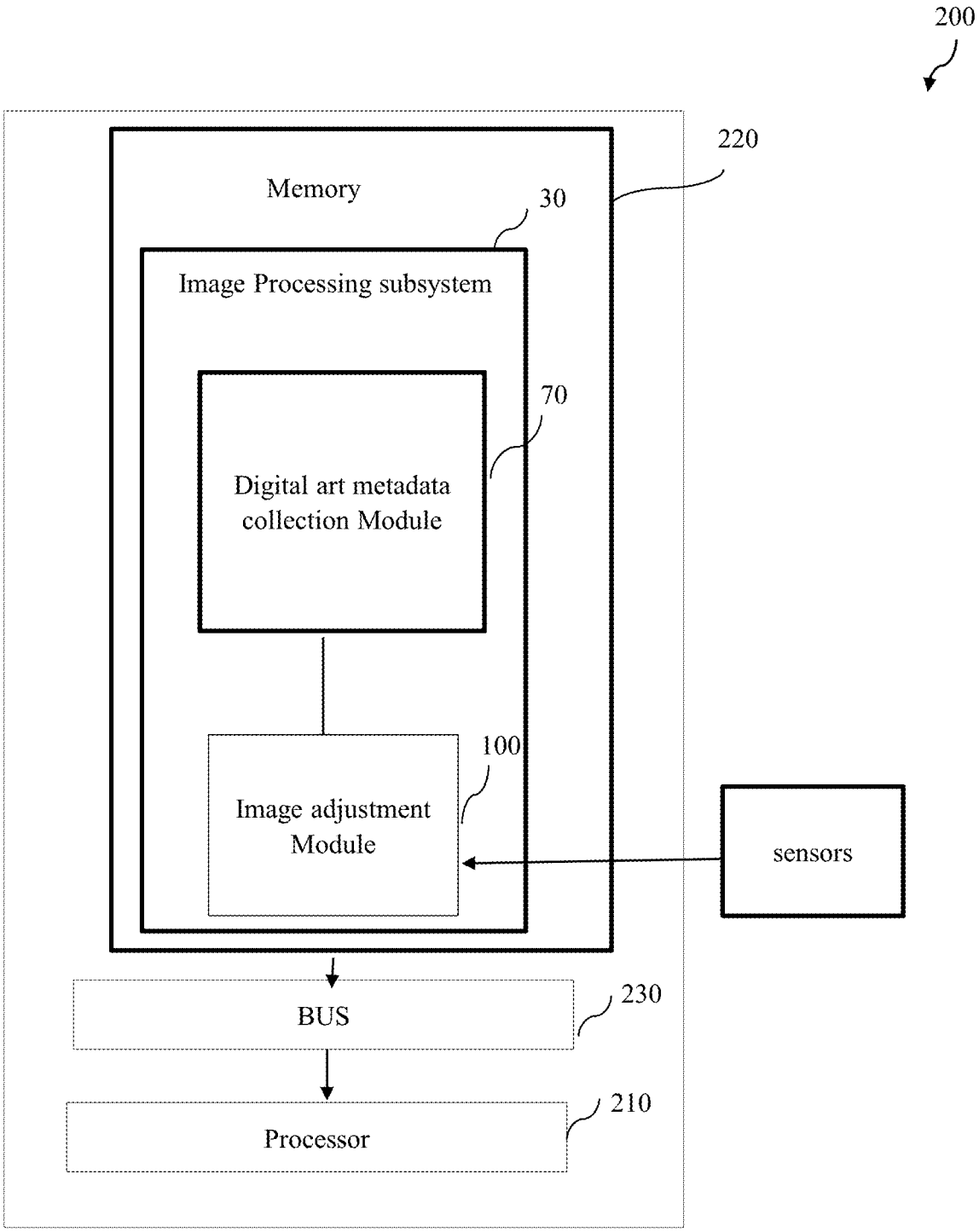
FIG. 4 is a computer or a server for the system for image enhancement in a digital display device in accordance with an embodiment of the present disclosure.

In addition, the image adjustment module 100 generates a target digital image 110 representative of a printed image quality of the sample printed art piece 60 based on the one or more parameters modified under the ambient condition. In one embodiment, the image adjustment module 100 may generate the target digital image 110 representative of the printed image quality using sample data collected statistically in real time. The sample data is collected by comparing the print art behaviour statistically. The target digital image 110 on the digital display device 20 is adjusted using the image processing techniques and one or more filters to give a feeling of print like image quality under the plurality of lighting conditions FIG. 4 is a computer or a server 200 for the system 10 for image enhancement on the digital display device 20 in accordance with an embodiment of the present disclosure. The server includes processor(s) 210, and memory 220 operatively coupled to the bus 230. The processor(s) 210, as used herein, means any type of computational circuit, such as, but not limited to, a microprocessor, a microcontroller, a complex instruction set computing microprocessor, a reduced instruction set computing microprocessor, a very long instruction word microprocessor, an explicitly parallel instruction computing microprocessor, a digital signal processor, or any other type of processing circuit, or a combination thereof.

The memory 220 includes a plurality of subsystems stored in the form of executable program which instructs the processor 210 to perform the method 250 steps illustrated in FIG. 1. The memory 220 has following subsystems: the image processing subsystem 30 including a digital art metadata collection module 70 and an image adjustment module 100.

The memory 220 includes an image processing subsystem 30 hosted on a server. The image processing subsystem 30 includes a digital art metadata collection module 70 configured to measure the ambient condition on a digital art piece of the digital display device using a plurality of sensors 90 coupled to the digital display device. The digital art metadata collection module 70 is also configured to collect a set of metadata corresponding to the digital art piece of the digital display device by analysing the ambient condition measured.

The image processing subsystem 30 further includes an image adjustment module 100 operatively coupled to the printed art metadata collection module 50 and the digital art metadata collection module 70. The image adjustment module 100 is also configured to modify one or more parameters on the digital display device based on the set of metadata collected by digital art metadata collection module using one or more image processing techniques. The image adjustment module 100 is further configured to generate a target digital image representative of a printed image quality based on the one or more parameters modified under the ambient condition.

Computer memory 220 elements may include any suitable memory device(s) for storing data and executable program, such as read only memory, random access memory, erasable programmable read only memory, electrically erasable programmable read only memory, hard drive, removable media drive for handling memory cards and the like. Embodiments of the present subject matter may be implemented in conjunction with program modules, including functions, procedures, data structures, and application programs, for performing tasks, or defining abstract data types or low-level hardware contexts. Executable programs stored on any of the above-mentioned storage media may be executable by the processor(s) 210.

Figure 5:
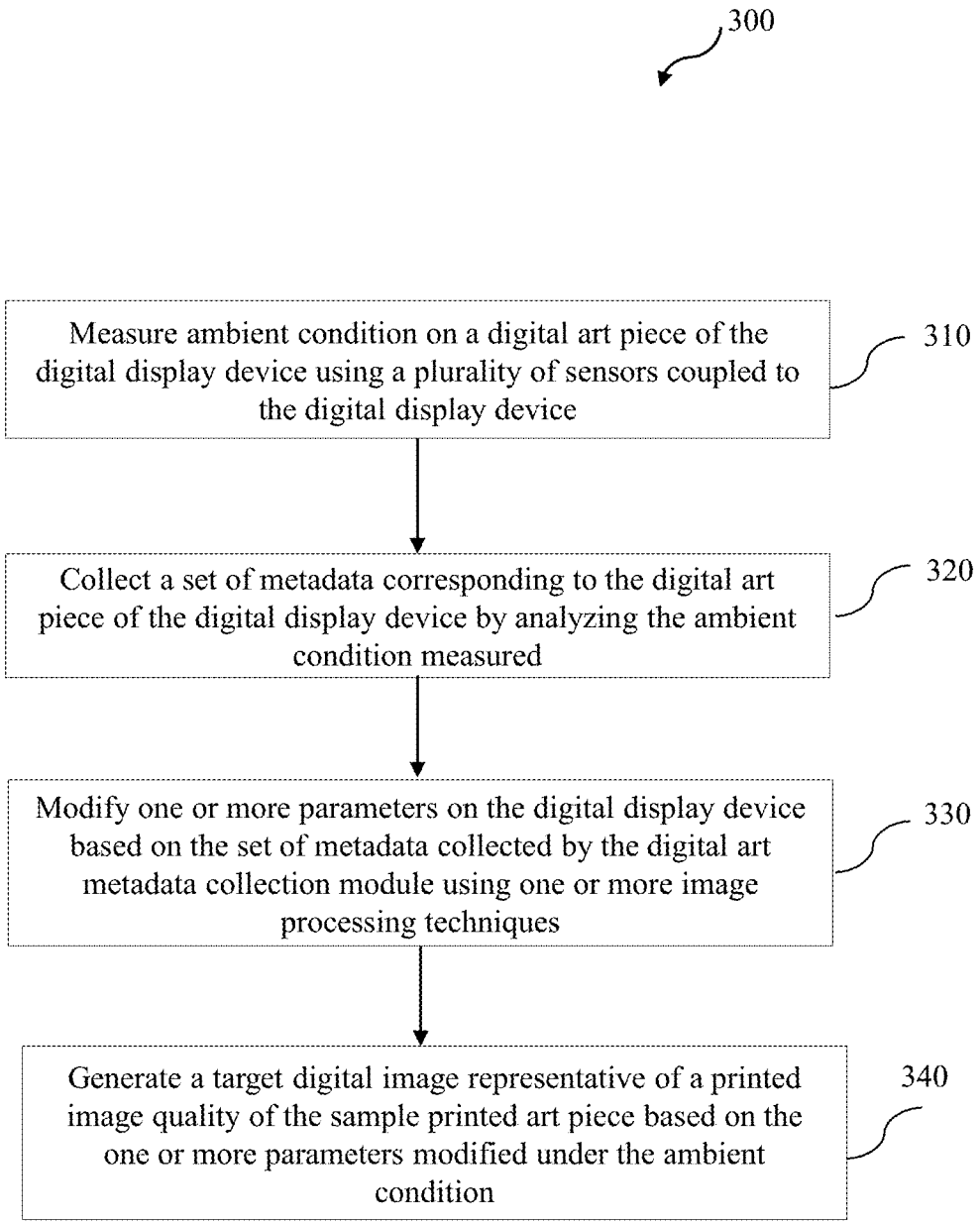
FIG. 5 is a flow chart representing the steps involved in a method for image enhancement in a digital display device in accordance with an embodiment of the present disclosure.

FIG. 5 is a flow chart representing the steps involved in a method 300 for image enhancement on the digital display device in accordance with an embodiment of the present disclosure. The method 300 also includes measuring the ambient condition on a digital art piece of the digital display device using sensors coupled to the digital display device in step 310. In one embodiment, measuring the ambient condition may include measuring the ambient condition on a digital art piece of the digital display device using sensors coupled to the digital display device by a digital art metadata collection module. In a specific embodiment, measuring the ambient condition on a digital art piece of the digital display device using sensors may include measuring the ambient condition on a digital art piece of the digital display device using at least one of a colour sensor, a brightness sensor, an infrared (IR) sensor or a combination thereof. The ambient condition may include a plurality of lighting conditions including colour temperature changes during day or evening or night.

The method 300 further includes collecting a set of metadata corresponding to the digital art piece of the digital display device by analysing measured ambient condition in step 320. In one embodiment, collecting a set of metadata may include collecting a set of metadata corresponding to the digital art piece of the digital display device by analysing measured ambient condition by the digital art metadata collection module. In a specific embodiment, collecting the set of metadata may include collecting at least one of brightness, sharpness, noise, colour, texture, saturation or a combination thereof. The brightness sensor and colour sensor along with the IR sensor continuously provide changing ambience data to the digital display device. Such second set of metadata includes, but is not limited to, white point of the ambient illumination under which the digital display device for the digital art piece is acquired.

Furthermore, the method 300 further includes modifying one or more parameters on the digital display device based on the set of metadata collected by the digital art metadata collection module using one or more image processing techniques in step 330. In one embodiment, modifying one or more parameters on the digital display device may include modifying one or more parameters on the digital display device based on the set of metadata collected by the digital art metadata collection module using one or more image processing techniques by the image adjustment module.

In one embodiment, modifying the one or more parameters on the digital display device may include determining a degree of modification of the one or more parameters based on historic data obtained by applying the first set of metadata on the digital art piece. In such an embodiment, modifying the one or more parameters may include modifying at least one of brightness, sharpness, noise, colour, texture, saturation or a combination thereof. The one or more parameters under the specified brightness and colour sensor information may be set and the image processing filters adjusts the images in real time. The reflection behaviour is multiplicative in nature. In other words, the amount of light reflected by sample printed art piece is proportional to ambient light while the reflection coefficient is wavelength dependent for a given surface. The same idea is used to achieve colour adaptation inside the digital display device and a colour adaptation filter is a non-linear implementation of such multiplicative behaviour. Special care has to be given for low light and heavy light conditions as human eyes tend to saturate in such conditions. Brightness adaptation is handled separately by adjusting the backlight brightness level of the digital display device in accordance with the ambient luminance level. Such relationship is logarithmic in nature.

The image adjustment module receives uses the feedback from colour sensor, brightness sensor and metadata information of the sample printed art piece and applies the one or more image processing techniques including noise adjustment, sharpness adjustment, colour temperature adjustment, brightness adjustment or the like along with brightness adjustment of the digital display device. The method 300 further includes generating a target digital image representative of a printed image quality based on the one or more parameters under the ambient condition in step 340. In one embodiment, generating a target digital image representative of a printed image quality may include generating a target digital image representative of a printed image quality of the sample printed art piece based on the one or more parameters under the ambient condition by the image adjustment module.

In a specific embodiment, generating the target digital image representative of the printed image quality may include generating the target digital image representative of the printed image quality using sample data collected statistically in real time. In one embodiment, the method 300 may include selecting a predetermined percentage of pixels periodically using a stochastic component of the one or more image processing techniques. In such an embodiment, selecting a predetermined percentage of pixels periodically may include selecting a predetermined percentage of pixels periodically using a stochastic component of the one or more image processing techniques by the image adjustment module. In such an embodiment, the method 300 may include varying intensity of the predetermined percentage of the pixels to obviate pixel burn phenomenon.

Various embodiments of the system and method for image enhancement on the digital display device as described above enables automatic image adjustment based on feedback received from brightness sensor of the room ambience in photo frames or TV applications recently. In such method, brightness sensor input helps adjust screen brightness such as lower brightness in the room enables lower screen brightness automatically to adjust the look of the image on the screen. The system simulates print art or realistic rendering of art experience on the digital monitor using feedback mechanism using colour, brightness and IR sensors data combined with image meta data and prior information about similar images characterized by standard image parameters.

It will be understood by those skilled in the art that the foregoing general description and the following detailed description are exemplary and explanatory of the disclosure and are not intended to be restrictive thereof.

While specific language has been used to describe the disclosure, any limitations arising on account of the same are not intended. As would be apparent to a person skilled in the art, various working modifications may be made to the method (250) in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

We claim:

1. A system for image enhancement on a digital display device comprising:

an image processing subsystem hosted on a server, wherein the image processing subsystem comprises:

a digital art metadata collection module configured to:

measure an ambient condition on a digital art piece of the digital display device using a plurality of sensors coupled to the digital display device; and collect a set of metadata corresponding to the digital art piece of the digital display device by analysing the ambient condition measured; and an image adjustment module operatively coupled to the digital art metadata collection module, wherein the image adjustment module is configured to:

modify one or more parameters on the digital display device based on the set of metadata collected by the digital art metadata collection module using one or more image processing techniques; and generate a target digital image representative of a printed image quality based on the one or more parameters modified under the ambient condition.

2. The system of claim 1, wherein the server comprises a cloud server.

3. The system of claim 1, wherein the server comprises a local server hosted on the digital display device.

4. The system of claim 1, wherein the set of metadata comprises at least one of brightness, sharpness, noise, colour, texture, saturation or a combination thereof.

5. The system of claim 1, wherein the plurality of sensors comprises at least one of a colour sensor, a brightness sensor, an infrared (IR) sensor or a combination thereof.

6. The system of claim 1, wherein the image adjustment module is configured to generate the target digital image representative of the printed image quality using sample data collected statistically in real time.

7. The system of claim 1, wherein the one or more parameters comprises at least one of brightness, sharpness, noise, colour, texture, saturation or a combination thereof.

8. The system of claim 1, wherein the image adjustment module is configured to modify brightness on the digital display device by adjusting backlight brightness level of the digital display device with ambient luminance level.

9. The system of claim 1, wherein the image adjustment module is configured to determine a degree of modification of the one or more parameters based on historic data obtained by applying the set of metadata on the digital art piece.

10. The system of claim 1, wherein the image adjustment module is configured to:

select a predetermined percentage of pixels periodically using a stochastic component of the one or more image processing techniques; and vary intensity of the predetermined percentage of the pixels to obviate pixel burn phenomenon.

11. A method comprising:

measuring, by a digital art metadata collection module, ambient condition on a digital art piece of the digital display device using a plurality of sensors coupled to the digital display device;

collecting, by the digital art metadata collection module, a set of metadata corresponding to the digital art piece of the digital display device by analysing measured ambient condition;

modifying, by the image adjustment module, one or more parameters on the digital display device based on the set of metadata collected by the digital art metadata collection module using one or more image processing techniques; and generating, by the image adjustment module, a target digital image representative of a printed image quality based on the one or more parameters under the ambient condition.

12. The method of claim 11, wherein generating the target digital image representative of the printed image quality comprises generating the target digital image representative of the printed image quality using sample data collected statistically in real time.

13. The method of claim 11, wherein modifying the one or more parameters on the digital display device comprises determining a degree of modification of the one or more parameters based on historic data obtained by applying the first set of metadata on the digital art piece.

14. The method of claim 11, comprising:

selecting, by the image adjustment module, a predetermined percentage of pixels periodically using a stochastic component of the one or more image processing techniques; and varying, by the image adjustment module, intensity of the predetermined percentage of the pixels to obviate pixel burn phenomenon.

15. A digital display device comprising:

a display screen incorporated in a frame, wherein the display screen is configured to display a digital art piece, wherein the digital art piece comprising a matrix of pixels;

a driving circuit electrically coupled to the display screen, wherein the driving circuit is configured to control the display screen to display the digital art piece; and a communication unit communicably coupled to a server, wherein the server comprises an image processing subsystem comprising:

a digital art metadata collection module configured to:

measure ambient condition on a digital art piece of the display screen using a plurality of sensors coupled to the display screen; and collect a set of metadata corresponding to the digital art piece of the display screen by analysing measured ambient condition; and an image adjustment module operatively coupled to the digital art metadata collection module, wherein the image adjustment module is configured to:

modify one or more parameters on the display screen based on the set of metadata collected by the digital art metadata collection module using one or more image processing techniques; and generate a target digital image representative of a printed image quality based on the one or more parameters under the ambient condition.

16. The device of claim 15, wherein the frame is composed of a material comprising at least one of wood, glass, plastic, metal or a combination thereof.

17. The device of claim 15, wherein the set of metadata comprises at least one of brightness, sharpness, noise, colour, texture, saturation or a combination thereof.

18. The device of claim 15, wherein the plurality of sensors comprises at least one of a colour sensor, a brightness sensor, an infrared (IR) sensor or a combination thereof.

19. The device of claim 15, wherein the image adjustment module is configured to generate the target digital image representative of the printed image quality using sample data collected statistically in real time.

20. The device of claim 15, wherein the image adjustment module is configured to:

select a predetermined percentage of pixels periodically using a stochastic component of the one or more image processing techniques; and vary intensity of the predetermined percentage of the pixels to obviate pixel burn phenomenon.

* * * * *